US008684246B2

(12) United States Patent
Liang et al.

(10) Patent No.: US 8,684,246 B2
(45) Date of Patent: Apr. 1, 2014

(54) DRIVING DEVICE FOR RESETTING HITTING NAIL BAR OF PNEUMATIC NAIL GUN

(75) Inventors: Chia-Sheng Liang, Taipei Hsien (TW); Chu Hsiang Tseng, Taipei Hsien (TW)

(73) Assignee: De Poan Pneumatic Corp., New Taipei (TW)

( * ) Notice: Subject to any disclaimer, the term of this patent is extended or adjusted under 35 U.S.C. 154(b) by 540 days.

(21) Appl. No.: 12/639,216

(22) Filed: Dec. 16, 2009

(65) Prior Publication Data

US 2011/0114692 A1 May 19, 2011

(30) Foreign Application Priority Data

Nov. 19, 2009 (TW) ..... 98139284 A

(51) Int. Cl.
*B25C 1/04* (2006.01)
*B25C 5/02* (2006.01)
*B25C 5/06* (2006.01)

(52) U.S. Cl.
USPC ..... 227/130

(58) Field of Classification Search
CPC ..... B25C 1/04
USPC ..... 227/130, 2, 7, 8, 107, 112; 173/90, 201
See application file for complete search history.

(56) References Cited

U.S. PATENT DOCUMENTS

| | | | | | |
|---|---|---|---|---|---|
| 4,075,850 | A * | 2/1978 | Nakazato et al. | 60/633 |
| 4,294,391 | A * | 10/1981 | Obergfell | 227/130 |
| 4,448,338 | A * | 5/1984 | Graf et al. | 227/8 |
| 4,784,308 | A * | 11/1988 | Novak et al. | 227/130 |
| 5,135,152 | A * | 8/1992 | Uno et al. | 227/116 |
| 5,320,187 | A * | 6/1994 | Pressley et al. | 173/15 |
| 5,911,351 | A | 6/1999 | White | |
| 7,290,691 | B1 | 11/2007 | Wen | |
| 7,293,684 | B1 * | 11/2007 | Wen | 227/130 |
| 7,377,413 | B2 | 5/2008 | Wen | |
| 8,479,963 | B2 * | 7/2013 | Kitagawa et al. | 227/8 |
| 2008/0190988 | A1 * | 8/2008 | Pedicini et al. | 227/130 |
| 2010/0200260 | A1 * | 8/2010 | Mikami et al. | 173/176 |
| 2010/0252288 | A1 * | 10/2010 | Hsu | 173/20 |
| 2013/0161050 | A1 * | 6/2013 | Pedicini | 173/201 |

* cited by examiner

*Primary Examiner* — Robert Long
(74) *Attorney, Agent, or Firm* — Chun-Ming Shih

(57) ABSTRACT

A driving device for resetting a hitting nail bar of the pneumatic nail gun, which is mounted in a gun body including a main air chamber, a trigger valve, a hitting nail bar and a bottom cylinder chamber disposed therein is provided. The driving device includes a main gas channel and a sensing valve component slidably disposed in the main gas channel. The main gas channel communicates with the main air chamber and the bottom cylinder chamber via the trigger valve. The sensing valve component is controlled by the position of the hitting nail bar to be either opened or closed. The sensing valve component is opened on the condition that a reset state of the hitting nail bar is excluded, and the high-pressure air is introduced from the main air chamber into the bottom cylinder chamber to drive the hitting nail bar to move upwardly to reset rapidly.

23 Claims, 11 Drawing Sheets

DRIVING DEVICE FOR RESETTING HITTING NAIL BAR OF PNEUMATIC NAIL GUN

BACKGROUND

The present invention relates to a driving device for resetting a hitting nail bar of a pneumatic nail gun, and particularly to a sensing valve component capable of sensing an operation of the hitting nail bar so as to control a high-pressure air for driving the hitting nail bar to reset.

A pneumatic nail gun is a kind of hand tool, which is powered by a high-pressure air to drive a hitting nail bar to operate. Generally, a pushable work contact element for controlling an order of hitting nails is disposed at the peripheral of a gun body. A number of main air chambers, a cylinder, a piston slidably mounted in the cylinder, a hitting nail bar connected to a bottom of the piston, a trigger valve for driving the hitting nail bar to hit nails are disposed in the gun body. The main air chambers can collect the high-pressure air continuously to remain a constant pressure therein. The cylinder is divided into a top cylinder chamber and a bottom cylinder chamber by the piston.

A user can push the work contact element on an object and press the trigger valve so as to switch a gas path of the high-pressure air in the gun body. Thus, the high-pressure air enters into the top cylinder chamber to drive the piston and the hitting nail bar connected to the bottom of the piston to move downwardly to shoot out the nails. Then, it is necessary for the user to set the work contact element and the trigger valve free so as to switch the gas path of the high-pressure air in the gun body again. Thus, the high-pressure air flows out of the top cylinder chamber and enters into the bottom cylinder chamber to drive the piston and the hitting nail bar connected to the bottom of the piston to move upwardly to reset.

In the conventional technology of driving the hitting nail bar to move upwardly to reset, one example is a pneumatically operated fastener drive device disclosed in U.S. Pat. No. 5,911,351. In this patent, an air chamber (also called a resilient air chamber) having a determined volume is disposed at the peripheral of the cylinder. The air chamber collects the high-pressure air having a limited volume, which is introduced from the top cylinder chamber during the downward movement of the piston. Meanwhile, the air chamber also collects the remaining air introduced by pushing the bottom cylinder chamber during the downward movement of the piston. Thus, after the user sets at least the work contact element free, the high-pressure air having a limited volume in the air chamber can be introduced into the bottom cylinder chamber to serve as a power source for driving the piston and the hitting nail bar to move upwardly to reset. However, because the limitation of the determined volume of the air chamber, the collected high-pressure air having the identical limited volume has a low pressure. The low pressure is lower than the pressure of the need high-pressure air introduced continuously into the gun body for driving to hitting nails. Thus, the reset speed of the piston and the hitting nail bar driven to move upwardly is not satisfying. Furthermore, during the downward movement of the piston, the collection of the high-pressure air from the top cylinder chamber or the collection of the remaining air in the bottom cylinder chamber will cause consumption or reduction of energy of hitting nails relatively. Thus, when the user operates the pneumatic nail gun to hitting nails continuously, the efficiency and smoothness of the operation can be affected.

Above-mentioned problems are improved, for example, in U.S. Pat. No. 7,290,691 and in U.S. Pat. No. 7,377,413. In theses patents, the collection of the high-pressure air having the identical limited volume to the air chamber (also called the resilient air chamber) is abandoned, and a gas passage and a valve are disposed at the peripheral of the cylinder. The gas passage is configured for communicating the main air chamber and the bottom cylinder chamber. The main air chamber can obtain a continuous supply of the high-pressure air having a constant pressure. A pressure difference between the top and the bottom of the valve is controlled. During the reset process of the piston and the hitting nail bar driven to move upwardly, the high-pressure air is continuously supplied and enters into the bottom cylinder chamber to drive the piston and the hitting nail bar to move upwardly rapidly to reset. However, the formation of the gas passage at the peripheral of the cylinder will increase the difficulty of forming the pneumatic nail gun. Moreover, it is necessary to control the pressure difference between the top and the bottom of the valve disposed in the gas passage. However, during hitting nails, it is difficult to control the pressure difference between the top and the bottom of the valve instantaneously.

BRIEF SUMMARY

The present invention provides a driving device for resetting a hitting nail bar of a pneumatic nail gun to overcome the following disadvantages of the conventional driving device described above.

1. During the downward movement of the hitting nail bar driven by the piston, the collection of the high-pressure air from the top cylinder chamber or the collection of the remaining air in the bottom cylinder chamber by using the air chamber having the determined limited volume is not benefit for improving the reset speed and stability of the piston and the hitting nail bar driven to move upwardly and will cause the consumption or reduction of energy of hitting nails in the cylinder relatively, thereby affecting the efficiency and the smoothness of the operation of hitting nails continuously.

2. The gas passage for communicating the main air chamber and the bottom cylinder chamber is disposed at the peripheral of the cylinder and the valve is disposed in the gas passage. Because the top of the valve must bear an action of high-pressure air having a constant pressure, it is necessary for the high-pressure air on the top of the valve to be accumulated so as to change the pressure difference between the top and the bottom of the valve to control the valve to reset. However, during hitting nails, it is difficult to control the pressure difference between the top and the bottom of the valve instantaneously.

3. The gas passage for communicating the main air chamber and the bottom cylinder chamber is disposed at the peripheral of the cylinder. The formation of the gas passage will increase the difficulty of forming the pneumatic nail gun.

The present invention provides a driving device for resetting a hitting nail bar of a pneumatic nail gun. The driving device is disposed in a gun body. The gun body has a main air chamber for high-pressure air, a trigger valve, a hitting nail bar and a bottom cylinder chamber disposed therein. The driving device includes a main gas channel and a sensing valve component. The main gas channel communicates with the main air chamber and the bottom cylinder chamber via the trigger valve. The main gas channel is located in the gun body and near to a shoot hole for guiding the hitting nail bar. The sensing valve component is slidably disposed in the main gas channel. The sensing valve component is controlled by the position of the hitting nail bar to be either opened or closed. The sensing valve component is opened on the condition that it is excluded that the hitting nail bar has been moved upwardly to be in a reset state. The high-pressure air is introduced from the main air chamber into the bottom cylinder chamber to drive the hitting nail bar to move upwardly to reset. Thus, the sensing valve component is closed and the high-pressure is prevented from entering into the bottom cylinder chamber.

The present invention also provides a driving device for resetting a hitting nail bar of a pneumatic nail gun. The driving device is mounted in a gun body. The gun body has a main air chamber for high-pressure air, a trigger valve, a hitting nail bar and a bottom cylinder chamber disposed therein. The driving device includes a main gas channel and a sensing valve component. The main gas channel communicates with the main air chamber and the bottom cylinder chamber via the trigger valve. The sensing valve component is slidably disposed in the main gas channel. The sensing valve component includes a pushing portion and a blocking portion. The pushing portion is configured for receiving a drive of the high-pressure air in the main gas channel. The blocking portion is configured for sensing the position of the hitting nail bar.

Accordingly, due to the limitation of the hitting nail bar, the blocking portion blocks the sensing valve component to be closed on the condition that it is excluded that the hitting nail bar has been moved upwardly to be in the reset state. That is, the sensing valve component is in an open state. Thus, the high-pressure air in the main gas channel is introduced into the bottom cylinder chamber to drive the hitting nail bar to move upwardly to reset, and the upward movement of the hitting nail bar sets the blocking portion free. As a result, the sensing valve component is driven by the high-pressure air to be closed, thereby preventing the high-pressure air from entering into the bottom cylinder chamber. Meanwhile, the blocking portion moves to an extending position for inspecting the reset hitting nail bar. At this time, the reset operation of the hitting nail bar driven to move upwardly is finished.

As above-mentioned, the present invention has at least the following advantageous:

1. The sensing valve component is configured for sensing an upward state or a downward state of the hitting nail bar during hitting nails. Thus, a downward hitting state or an upward reset state of the piston can be known, thereby controlling a time of the high-pressure air into the bottom cylinder chamber. The availability and accuracy of controlling a reset gas channel of the piston (i.e., the main gas channel) can be increased.

2. The sensing valve component is slidably disposed in the main gas channel for controlling a time of the high-pressure air having a constant pressure in the main air chamber into the bottom cylinder chamber. The reset speed and stability of the piston and the hitting nail bar driven to move upwardly can be enhanced, and the energy of the high-pressure air in the cylinder for driving the piston and the hitting nail bar to move downwardly to hit nails will not be affected. Thus, the efficiency and the smoothness of the operation of hitting nails continuously can be assured.

In one embodiment provided by the present invention, the main gas channel is disposed in the gun body and is near to the shoot hole. Thus, the main gas channel can be disposed near to an outside end of the gun body, thereby reducing the difficulty of modeling and drilling the main gas channel. When the sensing valve component is opened, the blocking portion moves to a reset position for releasing the hitting nail bar.

In addition, the trigger valve is disposed between the main air chamber and the main gas channel. When the trigger valve is used to control the pneumatic nail gun to hit nails, the trigger valve can prevent the high-pressure air from entering into the main gas channel and can guide the high-pressure air gathered in the main gas channel to an air outlet into the exterior air. That is, the trigger valve has a function of reducing the pressure in the main gas channel. When the trigger valve is not used to control the pneumatic nail gun to hitting nails, the high-pressure air from the main air chamber is introduced into the main gas channel. Thus, the trigger valve is configured for controlling the supply time of the high-pressure air in the reset gas channel of the piston (i.e., the main gas channel). A manner of controlling the pressure difference to drive the valve to move is not used here. Thus, the availability and accuracy of controlling the reset gas channel of the piston (i.e., the main gas channel) can be increased.

Further, the end of the blocking portion can have an arc-shaped surface or a slanted surface for being attached to the hitting nail bar to force the sensing valve component to be opened.

Additionally, a spring is disposed between the sensing valve component and an inside wall of the main gas channel. The spring is configured for driving the sensing valve component to be opened. When the trigger valve is used to control the pneumatic nail gun to hitting nails, the spring drives the sensing valve component so that the blocking portion arrives at the reset position for releasing the hitting nail bar, thereby operating the hitting nail bar to move downwardly to hit nails.

In order to efficiently drive the sensing valve component to the reset position for releasing the hitting nail bar so that the high-pressure air can enter into the bottom cylinder chamber, the mean of the spring for driving the sensing valve component to be opened can be substituted by one of the means as follow.

First, a sub gas channel is formed in the gun body and communicates the main air chamber with the sensing valve component. When the sensing valve component is closed, the sub gas channel guides the high-pressure air to gather and surround the sensing valve component so as to drive the sensing valve component to be opened. A guiding hole communicated with the main gas channel is formed in the sensing valve component. When the sensing valve component is opened, the high-pressure air in the main gas channel enters into the bottom cylinder chamber through the guiding hole. When the sensing valve component is closed, the high-pressure air in the guiding hole is blocked and can not enter into the bottom cylinder chamber.

Second, a contacting portion is formed on the sensing valve component and an end of a work contact element is extended to form a push pawl. The push pawl has a slanted surface so that the push pawl is capable of pushing and contacting the contacting portion within a relative distance. When the work contact element moves upwardly to push the contacting portion, the sensing valve component is driven to be opened. When the work contact element moves downwardly to reset, the contacting portion is released. A guiding hole communicated with a main gas channel is formed in the sensing valve component. When the sensing valve component is opened, the high-pressure air in the main gas channel enters into the bottom cylinder chamber through the guiding hole. When the sensing valve component is closed, the high-pressure air in the guiding hole is blocked and can not enter into the bottom cylinder chamber.

In addition, in one embodiment provided by the present invention, the extending position of the blocking portion of the sensing valve component can be limited to be located at the bottom of the hitting nail bar and in the shooting hole for guiding the hitting nail bar. In one embodiment provided by the present invention, a groove is defined on the hitting nail bar and is near to the bottom end of the hitting nail bar. The groove is configured for limiting the extending position for the blocking portion.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
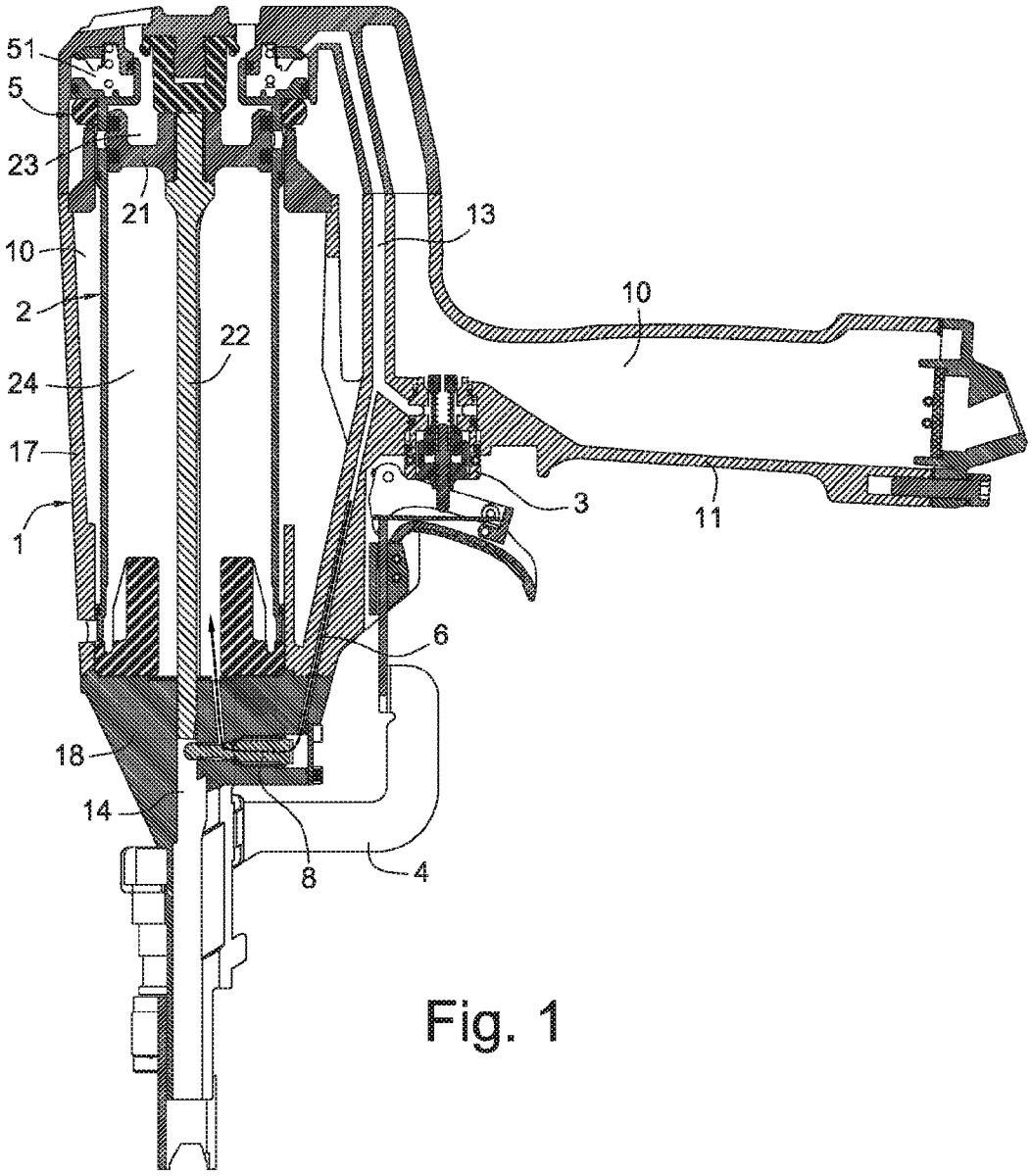
FIG. 1 is a schematic view of a pneumatic nail gun in accordance with a first embodiment of the present invention.
Figure 2:
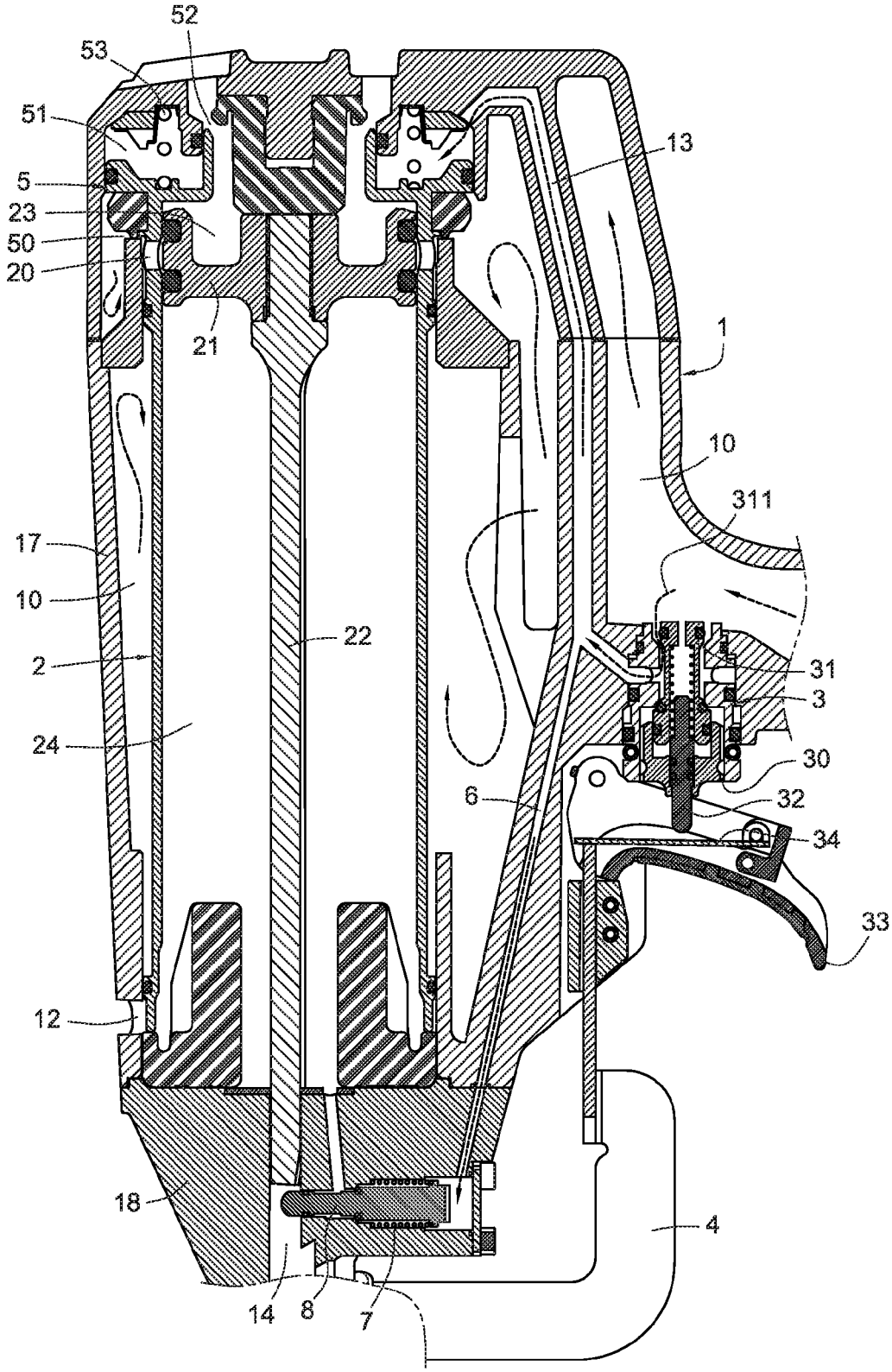
FIG. 2 is a partial exploded view of the pneumatic nail gun shown in FIG. 1.
Figure 3:
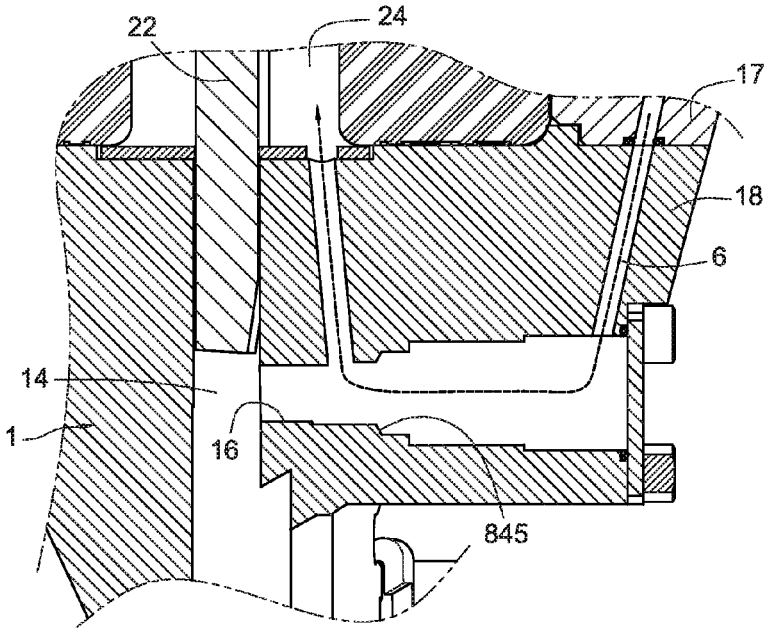
FIG. 3 is a schematic view of a main gas channel in accordance with a preferred embodiment of the present invention.

Referring to FIG. 1, a pneumatic nail gun in accordance with the first embodiment of the present invention is provided. Referring to FIG. 1 and FIG. 2, a driving device for resetting a hitting nail bar of the pneumatic nail gun in the first embodiment is disposed in a gun body 1 of the pneumatic nail gun. In addition, the gun body 1 disposes a cylinder 2 therein. In the present embodiment, the cylinder 2 can be a movable cylinder. A piston 21 is slidably mounted in the cylinder. A hitting nail bar 22 is connected to the bottom of the piston 21. The cylinder 2 is divided into a top cylinder chamber 23 and a bottom cylinder chamber 24 by the piston 21. A number of main air chambers 10 for high-pressure air are formed in the gun body 1. The main air chambers 10 are communicated with each other and distributed at the peripheral of the cylinder 2 and in the hand portion 11. The main air chambers 10 can collect a high-pressure air introduced from the end of the hand portion 11. The high-pressure air is supplied by an external apparatus and remains a constant pressure. A number of main gas holes 20 is disposed and surrounds the top end of the cylinder 2. The main gas holes 20 are configured for communicating the top cylinder chamber 23 and the main air chambers 10. A trigger valve 3 communicated with the main air chambers 10 is disposed on a side of the gun body 1 adjacent to the hand portion 11. The trigger valve 3 is configured for controlling the high-pressure air in the main air chambers 10 to drive the hitting nail bar 22 connected to the piston 21 to hit nails. A work contact element 4 is slidably mounted on an outside wall of the gun body 1. The gun body 1 has a shooting hole 14 therein. The shooting hole 14 is formed at the bottom of the gun body 1 and is configured for guiding the hitting nail bar. A head valve 5 is disposed on the top of the cylinder 2.

In the present embodiment, the head valve 5 can be formed on the top of the cylinder integrally (as shown in FIG. 1 and FIG. 2). Thus, the head valve 5 can move upward and downward with the cylinder 2 synchronously (further referring to FIG. 5). A pressure accumulating chamber 51 is disposed between a top inside wall of the gun body 1 and the head valve 5. The peripheral of the head valve 5 is adjacent to the main gas hole 20 and an inside wall of the gun body 1, thereby forming a main valve port 50 communicating the main air chambers 10 with the main gas hole 20. An upper gas escaping valve port 52 is formed between the top of the head valve 5 and the top inside wall of the gun body 1 for communicating the top cylinder chamber 23 with the exterior air. A lower gas escaping valve port 12 is formed between the bottom peripheral of the cylinder 2 and a bottom inside wall of the gun body 1 for communicating the bottom cylinder chamber 24 with the exterior air. A compression spring 53 is perpendicularly disposed in the pressure accumulating chamber 51.

Further, a trigger gas channel 13 communicating with the pressure accumulating chamber 51 is formed in the gun body 1 (as shown in FIG. 1 and FIG. 2). The bottom of the trigger valve 3 has an air outlet 30 for communicating the exterior air with the interior of the trigger valve 3. A valve housing 31 is slidably disposed in the trigger valve 3. The valve housing 31 has a trigger valve stem 32 slidably disposed therein. An input channel 311 and an output channel 312 are formed between the valve housing 31 and the inside wall of the trigger 3. The input channel 311 and the output channel 312 can be switched by the trigger valve stem 32 (further referring to FIG. 5). The input channel 311 is configured for communicating the main air chambers 10 and the trigger gas channel 13, and the output channel 312 is configured for communicating the trigger gas channel 13 with the air outlet 30. A trigger 33 is pivoted to a side of the gun body 1. An inner trigger 34 is pivotally disposed in the trigger 33 and is capable of receiving the pushing and swinging of the end of the work contact element 4. It is noted that the trigger valve stem 32 extends to a position where the inner trigger 34 can push the trigger valve stem 32.

Figure 5:
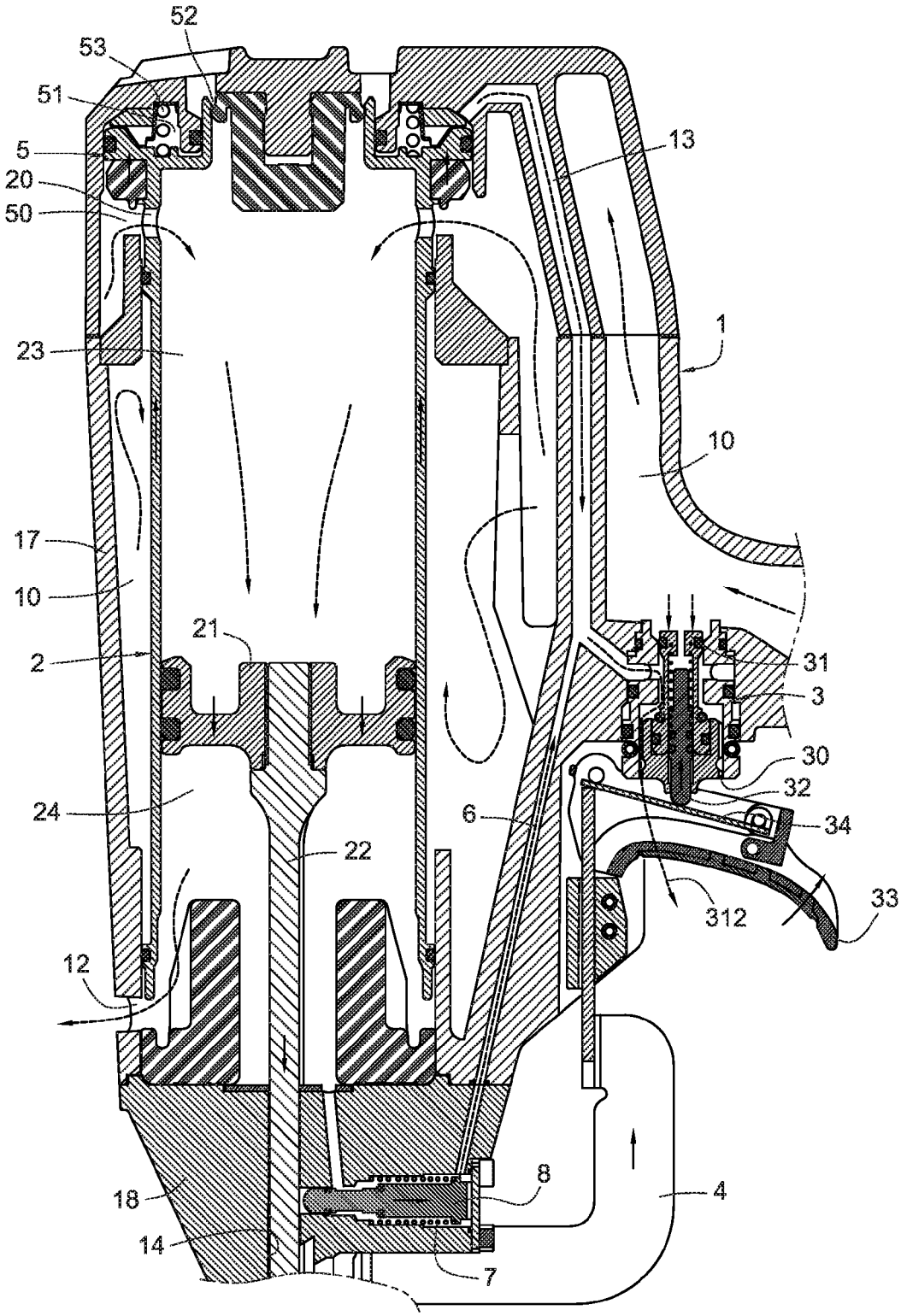
FIG. 5 is a schematic view of the pneumatic nail gun shown in FIG. 2, which is in a using state.

When the trigger valve stem 32 is released by the trigger 33 to move downwardly (as shown in FIG. 2), the valve housing 31 is driven by the high-pressure air in the main air chambers 10 to move upwardly. Thus, the input channel 311 is opened while the output channel 312 is closed. The high-pressure air in the main air chambers 10 will enter into the pressure accumulating chamber 51 through the input channel 311 and the trigger gas channel 13 to drive the head valve 5 and the cylinder 2 to move downwardly. As a result, the upper gas escaping valve port 52 is opened, and the main valve port 50 and the lower gas escaping valve port 12 are closed. It is noted that, the compression spring 53 can assist the high-pressure air to drive the head valve 5 and the cylinder 2 to move downwardly. When the trigger valve stem 32 is pressed by the trigger 33 to move upwardly (as shown in FIG. 5), the valve housing 31 is driven by the high-pressure air in the main air chambers 10 to move downwardly. Thus, the output channel 312 is opened while the input channel 311 is closed. The high-pressure air in the pressure accumulating chamber 51 enters into the exterior air through the trigger gas channel 13, the output channel 312 and the air outlet 30 so that the high-pressure air in the main air chambers 10 at the peripheral of the cylinder 2 drives the head valve 5 and the cylinder 2 to move upwardly. As a result, the upper gas escaping valve port 52 is closed, and the main valve port 50 and the lower gas escaping valve port 12 are opened.

It is noted that the cylinder 2, the trigger valve 3, the work contact element 4 and the head valve 5 are not limited by the description in the above-mentioned preferred embodiment. For example, the work contact element 4 and the inner trigger 34 can be omitted in some pneumatic nail guns. Thus, the trigger valve stem 32 can still be switched by pressing or releasing the trigger 33 to control the high-pressure air to drive the cylinder 2 to move upwardly or downwardly. In addition, the cylinder 2 is not limited to a movable cylinder in the above-mentioned preferred embodiment. In others words, any pneumatic nail guns equipped with a fixed cylinder, which control the high-pressure air by using the trigger valve to drive nails are within the scope and spirit of the invention disclosed herein.

Further, the gun body 1 includes a main gas channel 6 and a sensing valve component 8 disposed therein (as shown in FIG. 1 to FIG. 4). The main gas channel 6 communicates with the main air chambers 10 and the bottom cylinder chamber 24 via the trigger valve 3. In the present embodiment, the main gas channel 6 can be near to a shooting hole 14. Actually, the gun body 1 can be formed integrally or can include a main body 17 and a shooting nozzle base 18 connected to the bottom of the main body 17. In other embodiment, the main gas channel 6 can also be disposed in the main body 17 and the shooting nozzle base 18. Thus, the main gas channel 6 is near to an outside end of the gun body 1, thereby reducing the difficulty of modeling and drilling the main gas channel 6.

The sensing valve component 8 can be a valve stem having a cylindrical configuration and is slidably disposed in the main gas channel 6 (as shown in FIG. 1 to FIG. 4). The sensing valve component 8 includes a pushing portion 81 and a blocking portion 82. The pushing portion 81 is configured for receiving a drive of the high-pressure air in the main gas channel 6. The blocking portion 82 is configured for sensing a position of the hitting nail bar 22. In the present embodiment, a transverse guiding and supporting opening 16 is formed in the gun body 1 and at the bottom of the gun body 1. The guiding and supporting opening 16 is configured for communicating the shooting hole 14 and a bending portion of the main gas channel 6. The sensing valve component 8 is slidably in the main gas channel 6 and the guiding and supporting opening 16 transversely. Thus, the blocking portion 82 can pass through the guiding and supporting opening 16 into the shooting hole 14. The sensing valve component 8 further includes a main gas valve 84 for controlling the sensing valve component 8 to be opened or to be closed. The main gas valve 84 includes a first stopping gas ring 841 and a second stopping gas ring 842. The first stopping gas ring 841 is disposed on and rounds the outside surface of the section of the sensing valve component 8 adjacent to the blocking portion 82. The second stopping gas ring 842 is disposed on and rounds the outside surface of the middle section of the sensing valve component 8. A main gas valve port 845 is formed on the inside wall of the main gas channel 6 adjacent to the bottom cylinder chamber 24. The main gas valve port 845 is located between the bottom cylinder chamber 24 and the second stopping gas ring 842.

Figure 4:
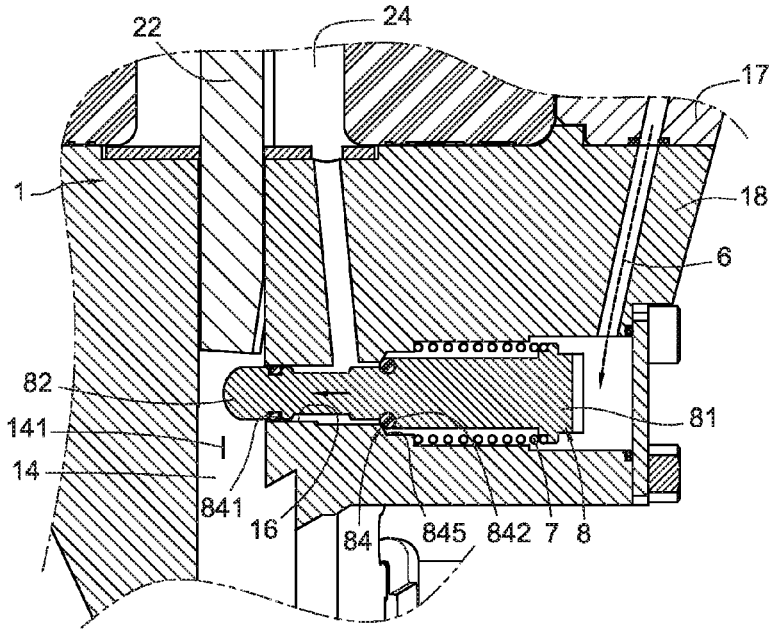
FIG. 4 is a partial exploded view of the pneumatic nail gun shown in FIG. 2.
Figure 6:
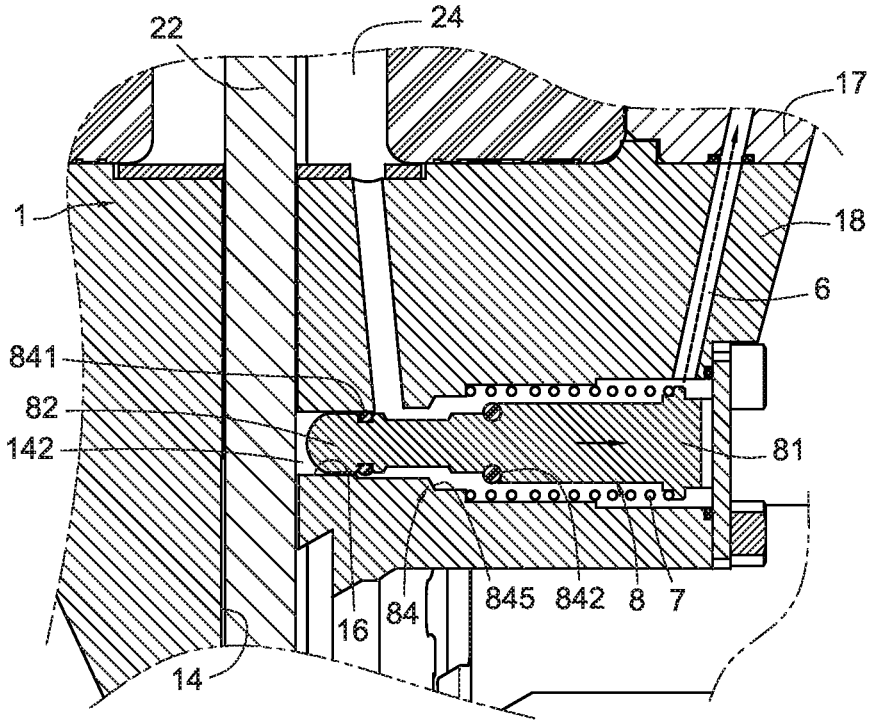
FIG. 6 is a partial exploded view of the pneumatic nail gun shown in FIG. 5.

Therefore, when the sensing valve component 8 moves to the shooting hole 14, the second stopping gas ring 842 can move towards the shooting hole 14 with the movement of the sensing valve component 8 so as to block the main gas valve port 845 (as shown in FIG. 4). Thus, the sensing valve component 8 is closed to block the communication of the main gas channel 6 with the bottom cylinder chamber 24 through the main gas valve port 845. Meanwhile, the blocking portion 82 can move with the movement of the sensing valve component 8 towards the shooting hole 14 with the movement of the sensing valve component 8, thereby passing through the guiding and supporting opening 16 into the shooting hole 14 to arrive at an extending position 141 for inspecting the reset of the hitting nail bar 22. Additionally, when the sensing valve component 8 moves away from the shooting hole 14, the second stopping gas ring 842 can move away from the shooting hole 14 with the movement of the sensing valve component 8 so as to leave the main gas valve port 845 (as shown in FIG. 6). Thus, the sensing valve component 8 is opened to connect the communication of the main gas channel 6 with the bottom cylinder chamber 24 through the main gas valve port 845. Meanwhile, the blocking portion 82 can move away from the shooting hole 14 with the movement of the sensing valve component 8, thereby entering into the guiding and supporting opening 16 to arrive at a reset position 142 for releasing the hitting nail bar 22. The first stopping gas ring 841 is configured for stopping the air in the main gas channel 6 entering into the shooting hole 14.

Figure 8:
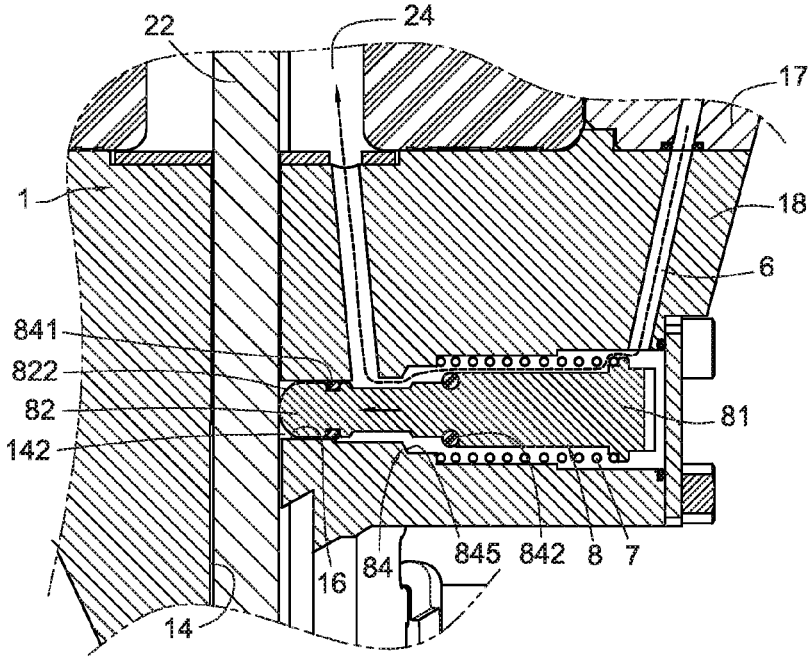
FIG. 8 is a partial exploded view of the pneumatic nail gun shown in FIG. 7.
Figure 9:
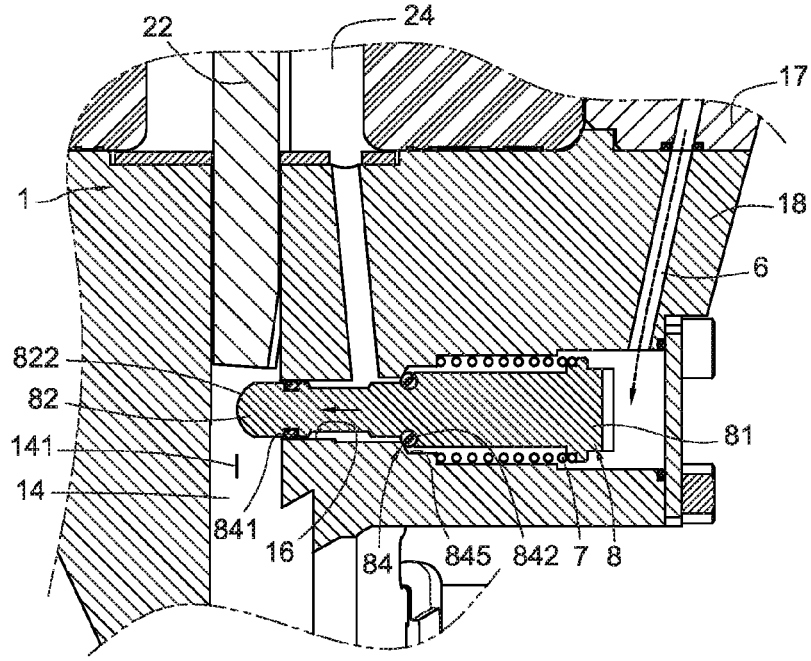
FIG. 9 is a schematic view of the pneumatic nail gun shown in FIG. 7, which is in a using state.

Accordingly, the sensing valve component 8 is opened on the condition that it is excluded that the hitting nail bar has been moved upwardly to be in a reset state (i.e., the hitting nail bar 22 has not been moved upwardly to reset completely after the hitting nail bar 22 is driven to move downwardly to hitting nails) (as shown in FIG. 8). The pushing portion 81 is driven by the high-pressure air in the main gas channel 6, which is introduced from the main air chambers 10. Thus, the sensing valve component 8 is driven to move towards to the shooting hole 14. During the movement of the sensing valve component 8, the blocking portion 82 arrives at and stays at the reset position 142 due to the block of the hitting nail bar 22. That is, the blocking portion 82 can block the sensing valve component 8 to be closed so that the sensing valve component 8 is in an open state. Then, the high-pressure air in the main gas channel 6 will enter into the bottom cylinder chamber 24 through the main gas valve port 845 to drive the piston and the hitting nail bar 22 to move upwardly to reset. At the moment of finishing the reset of the hitting nail bar 22 driven to move upwardly (as shown in FIG. 9), the block of the hitting nail bar 22 is eliminated. Thus, the high-pressure air in the main gas channel 6 will continually drive the sensing valve component 8 to move towards the shooting hole 14 so that the blocking portion 82 passes through the guiding and supporting opening 16 to arrives at the extending position 141 in the shooting hole 14, thereby closing the sensing valve component 8. Thus, the high-pressure air is blocked and can not enter into the bottom cylinder chamber 24, thereby finishing the reset operation of the hitting nail bar 22 driven to move upwardly. Therefore, the open state and the close state of the sensing valve component 8 are controlled by the position of the hitting nail bar 22.

Additionally, in order to efficiently drive the sensing valve component 8 to be opened so that the high-pressure air in the main gas channel 6 can enter into the bottom cylinder chamber 24, a pneumatic nail gun in accordance with the second embodiment of the present invention is provided. The pneumatic nail gun is similar to the pneumatic nail gun in the first embodiment except that a spring 7 is disposed between the sensing valve component 8 and the inside wall of the main gas channel 6 (as shown in FIG. 2 and FIG. 4). The spring 7 can round the sensing valve component 8 and in the main gas channel 6 between the main gas valve port 845 and the main air chambers 10. The spring 7 is compressed and is configured for driving the sensing valve component 8 to be opened when the sensing valve component 8 is driven by the high-pressure air in the main gas channel 6 to be closed (as shown in FIG. 6). When the trigger valve 3 is used to control the pneumatic nail gun to hitting nails, the spring 7 can drive the sensing valve component 8 to move away from the shooting hole 14. Thus, the blocking portion 82 can arrive at the reset position 142, thereby operating the hitting nail bar 22 to move downwardly to hit nails.

In the present embodiment, the trigger valve 3 is disposed between the main air chambers 10 and the main gas channel 6 (as shown in FIG. 1 and FIG. 2). The main gas channel 6 is communicated with the trigger valve 3. Thus, the trigger valve 3 can be configured for switching the main channel 6 to communicate with the input channel 311 or to communicate with the output channel 312 (further referring to FIG. 5). In fact, the main gas channel 6 and the trigger gas channel 13 can both communicate with the trigger valve 3. When the trigger valve 3 is used to control the pneumatic nail gun to hitting nails, the trigger valve 3 can prevent the high-pressure air from entering the main gas channel 6 and guide the gathered high-pressure air in the main gas channel 6 to the air outlet 30 through the output channel 312 into the exterior air. That is, the trigger valve 3 has a function of reducing the pressure in the main gas channel 6. When the trigger valve 3 is not used to control the pneumatic nail gun to hitting nails, the high-pressure air from the main air chambers 10 is introduced into the main gas channel 6 through the input channel 311.

According to the structure of the pneumatic nail, when the pneumatic nail is not operated by a user (as shown in FIG. 1 and FIG. 2), the high-pressure air in the main air chambers 10 will enter into the pressure accumulating chamber 51 through the input channel 311 of the trigger valve 3 and the trigger gas channel 13. The high-pressure air accumulates the pressure to drive the head valve 5 and the cylinder 2 to move downwardly, thereby opening the upper gas escaping valve port 52 and closing the main valve port 50 and the lower gas escaping valve port 12. Thus, the piston 21 is kept at the top of the cylinder 2 and in the head valve 5. Meanwhile, the high-pressure air in the main air chambers 10 will enter into the pressure accumulating chamber 51 through the input channel 311 of the trigger valve 3. The high-pressure air accumulates the pressure to apply a pushing force with a constant high-pressure to the pushing portion 81 of the sensing valve component 8 (further referring to FIG. 4), thereby driving the sensing valve component 8 to move towards the shooting hole 14 and to compress the spring 7. Thus, the blocking portion 82 is driven to move into the shooting hole 14 to arrive at the extending position 141 for inspecting the reset of the hitting nail bar 22. The second stopping gas ring 842 blocks the main gas valve port 845 so that the main gas valve 84 of the sensing valve component 8 is closed, thereby blocking the high-pressure air in the main gas channel 6 to enter into the bottom cylinder chamber 24 through the main gas valve port 845.

At the moment of pressing the trigger 33 (as shown in FIG. 5), the trigger 33 with the inner trigger 34 will push the trigger valve stem 32 to move upwardly so that the valve housing 31 is driven by the high-pressure air in the main air chambers 10 to move downwardly. Thus, the output channel 312 is opened and the input channel 311 is closed. The high-pressure air in the main gas channel 6 enters into the exterior air through the output channel 312 and the air outlet 30 (further referring to FIG. 6) so as to eliminate the pressure in the main gas channel 6. The spring 7 drives the sensing valve component 8 to move away from the shooting hole 14 so that the blocking portion 82 moves into the guiding and supporting opening 16 to arrive at the reset position 142 for releasing the hitting nail bar 22. As a result, the shooting hole 14 is opened so that the hitting nail bar 22 can move downwardly and pass therethrough. The second stopping gas ring 842 leave the main gas valve port 845 so that the main gas valve 84 of the sensing valve component 8 is opened. Thus, the high-pressure air in the main gas channel 6 enters into the bottom cylinder chamber 24 through the main gas valve port 845. Meanwhile, the high-pressure air in the pressure accumulating chamber 51 enters into the exterior air through the trigger gas channel 13, the output channel 312 and the air outlet 30. The high-pressure air in the main air chambers 10 at the peripheral of the cylinder 2 drives the head valve 5 and the cylinder 2 to move upwardly, thereby closing the upper gas escaping valve port 52 and opening the main valve port 50 and the lower gas escaping valve port 12. Then, the high-pressure air in the main chambers 10 will enter into the cylinder 2 through the main valve port 50 and the main gas hole 20 to fill the top cylinder chamber 23, thereby driving the piston 21 with the hitting nail bar 22 to move downwardly in the shooting hole 14 to hit nails. The air in the bottom cylinder chamber 24 will enter into the exterior air through the lower gas escaping valve port 12 and the shooting hole 14.

Figure 7:
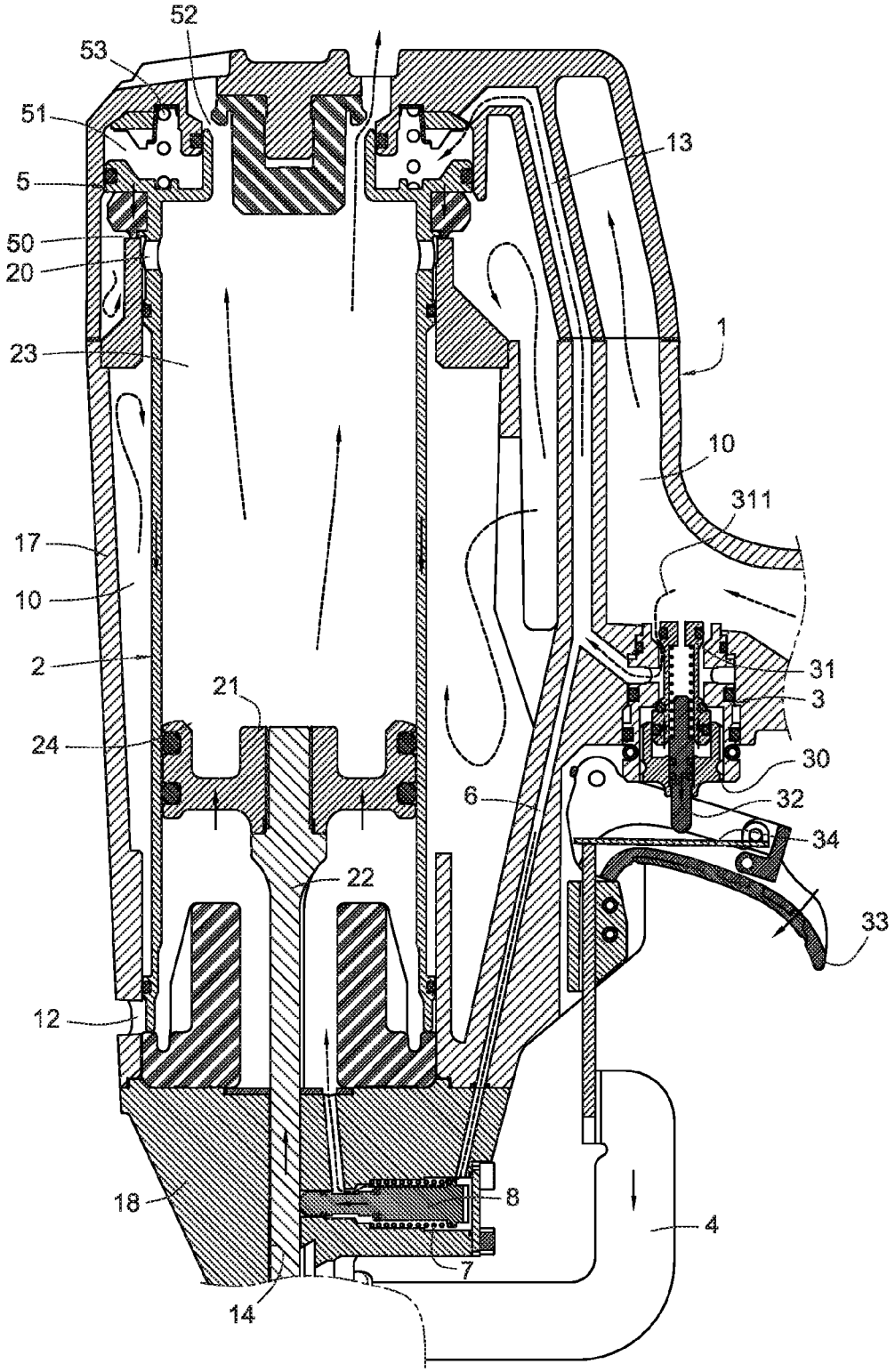
FIG. 7 is a schematic view of the pneumatic nail gun shown in FIG. 5, which is in a using state.

At the moment of releasing the trigger 33 (as shown in FIG. 7), the trigger 33 with the inner trigger 34 will set the trigger valve stem 32 free to move downwardly to reset so that the valve housing 31 is driven by the high-pressure air in the main air chambers 10 to move upwardly to reset. Thus, the input channel 311 is opened and the output channel 312 is closed. The high-pressure air in the main air chambers 10 enters into the pressure accumulating chamber 51 through the input channel 311 and the trigger gas channel 13. The high-pressure air in the pressure accumulating chamber 51 and the compression spring 53 to drive the head valve 5 and the cylinder 2 to move downwardly together, thereby closing the main valve port 50 and the lower gas escaping valve port 12. Thus, the high-pressure air in the main air chambers 10 is blocked to enter into the top cylinder chamber 23 through the main valve port 50. At this time, the upper gas escaping valve port 52 is opened so that the air in the top cylinder chamber 23 can enter into the exterior air through the upper gas escaping valve port 52. Meanwhile, the high-pressure air in the main air chambers 10 enters into the main gas channel 6 through the input channel 311 (further referring to FIG. 8). The high-pressure air in the main gas channel 6 accumulates the pressure to drive the sensing valve component 8 to move towards the shooting hole 14 and to compress the spring 7. Thus, on the condition that it is excluded that the hitting nail bar 22 has been moved upwardly to be in the reset state, the high-pressure air in the main gas channel 6 drives the sensing valve component 8 to move toward the shooting hole 14 and the blocking portion 82 is blocked by the hitting nail bar 22. That is, the blocking portion 82 can block the sensing valve component 8 to be closed so that the sensing valve component 8 is in an open state. Therefore, the high-pressure air in the main gas channel 6 can enter into the bottom cylinder chamber 24 through the main gas valve port 845 to drive the piston 21 and the hitting nail bar 22 to move upwardly to reset. After the piston 21 and the hitting nail bar 22 move upwardly to reset (as shown in FIG. 9), the block of the hitting nail bar 22 is eliminated. Thus, the high-pressure air in the main gas channel 6 will continually drive the sensing valve component 8 to move towards the shooting hole 14, thereby driving the sensing valve component 8 to be closed. Thus, the high-pressure air is blocked and can not enter into the bottom cylinder chamber 24 and the blocking portion 82 moves to arrive at the extending position 141, thereby finishing the reset operation of the hitting nail bar 22 driven to move upwardly.

As mentioned above, the embodiments of the present invention have been disclosed the pneumatic nail gun expressly and adequately. In particularly, the sensing valve component 8 is used to sense an upward state or a downward state of the hitting nail bar 22 during hitting nails. Thus, a downward hitting state or an upward reset state of the piston 21 can be known, thereby controlling the time of the high-pressure air into the bottom cylinder chamber 24. The availability and accuracy of controlling a reset gas channel of the piston 21 (i.e., the main gas channel 6) can be increased. In addition, the sensing valve component 8 is slidably disposed in the main gas channel 6 for controlling the time of the high-pressure air with a constant pressure in the main air chambers 10 into the bottom cylinder chamber 24. The reset speed and stability of the piston 21 and the hitting nail bar 22 driven to move upwardly can be enhanced and the energy of the high-pressure air in the cylinder 2 for driving the piston 21 and the hitting nail bar 22 to move downwardly to hit nails will not be affect. The efficiency and the smoothness of the operation of hitting nails continuously can be assured. Further, the trigger valve 3 controls the piston 21 to control the supply time of the high-pressure air in the reset gas channel of the piston 21 (i.e., the main gas channel 6). A manner of controlling the pressure difference to drive the valve to move is not used here. Thus, the availability and accuracy of controlling the reset gas channel of the piston 21 (i.e., the main gas channel 6) can be increased.

Additionally, the end of the blocking portion 82 can have an arc-shaped surface 822 (as shown in FIG. 9) or a slanted surface. When the hitting nail bar 22 moves downwardly, the hitting nail bar 22 attaches to the arc-shaped surface 822 or the slanted surface (as shown in FIG. 8). Thus, the blocking portion 82 of the sensing valve component 8 goes back into the guiding and supporting opening 16 and is forced to arrive at the reset position 142 for releasing the hitting nail bar 22 so that the high-pressure air can enter into the bottom cylinder chamber 24.

Furthermore, the embodiment of the spring 7 for driving the sensing valve component 8 to be opened can find a substitute in a third embodiment and a fourth embodiment as follow.

Figure 10:
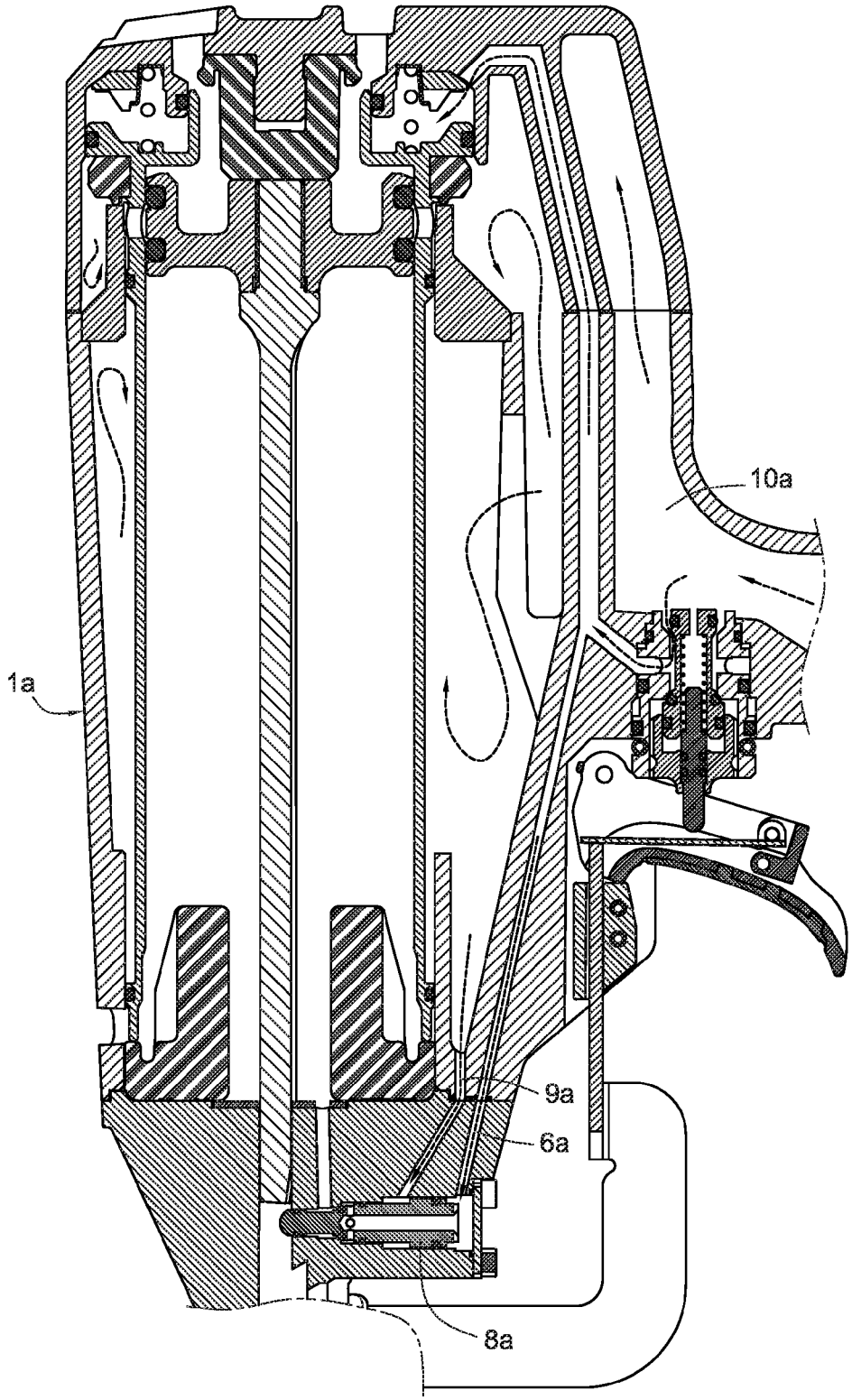
FIG. 10 is a schematic view of a pneumatic nail gun in accordance with a third embodiment of the present invention.
Figure 11:
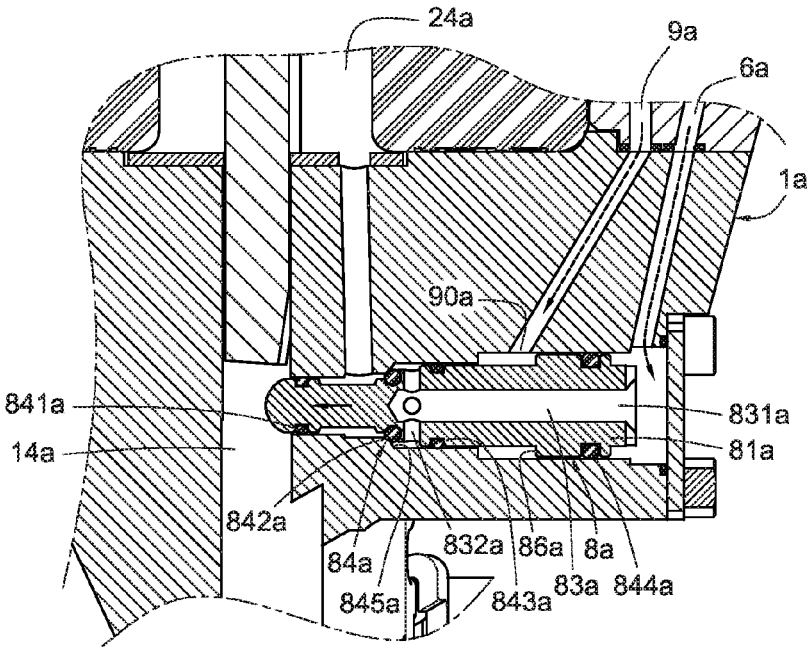
FIG. 11 is a partial exploded view of the pneumatic nail gun shown in FIG. 10.
Figure 12:
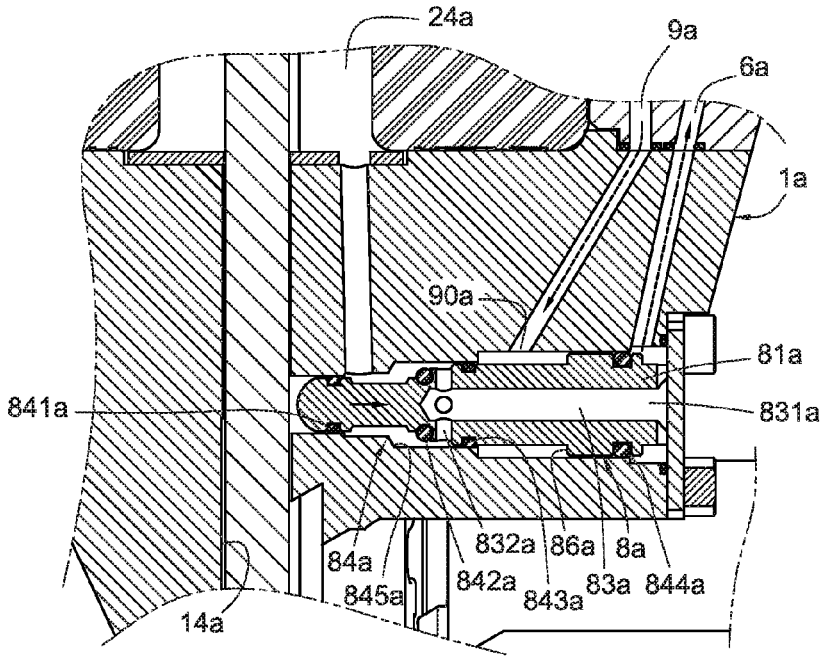
FIG. 12 is a schematic view of a schematic view of the pneumatic nail gun shown in FIG. 11, which is in a using state.

Referring to FIG. 10, a pneumatic nail gun in accordance with the third embodiment of the present invention is provided. Referring to FIG. 10 and FIG. 11, a sub gas channel 9*a* is formed in a gun body 1*a* and communicates a main air chamber 10*a* with a sensing valve component 8*a*. In the present embodiment, the sub gas channel 9*a* is communicated with the main air chamber 10*a*. An opening 90*a* is formed on the inside surface of a main gas channel 6*a* where the sensing valve component 8*a* is disposed. A main gas valve port 845*a* of a main gas valve 84*a* is located at the inside surface of the main gas channel 6*a* and between a bottom cylinder chamber 24*a* and the opening 90*a*. A guiding hole 83*a* communicated with the main gas channel 6*a* is formed in the sensing valve component 8*a*. The guiding hole 83*a* can be substantially formed in the sensing valve component 8*a*. The guiding hole 83*a* has a gas inlet 831*a* at a blocking portion 81*a* for communicating with the main gas channel 6*a* and a number of gas outlets 832*a* around the outside surface of the section of the sensing valve component 8*a* adjacent to a second stopping gas ring 842*a*. The gas outlets 832*a* are located between the second stopping gas ring 842*a* and the opening 90*a*. A third stopping gas ring 843*a* is disposed at and rounds the outside surface of the section of the sensing valve component 8*a* between the gas outlets 832*a* and the opening 90*a*. A fourth stopping gas ring 844*a* is disposed at and rounds the outside surface of the section of the sensing valve component 8*a* adjacent to a pushing portion 81*a*. That is, the opening 90*a* is located between the third stopping gas ring 843*a* and the stopping gas ring 844*a*. An annular contacting portion 86*a* is formed on the outside surface of the section of the sensing valve component 8*a* between the opening 90*a* and the fourth stopping gas ring 844*a*. When the sensing valve component 8*a* moves towards a shooting hole 14*a*, the second stopping gas ring 842*a* can move towards a shooting hole 14*a* with the movement of the sensing valve component 8*a* so as to block the main gas valve port 845*a*. Thus, the sensing valve component 8*a* is closed to block the high-pressure air in the main gas channel 6*a* into the bottom cylinder chamber 24*a* through the gas inlet 831*a*, the guiding hole 83*a*, the gas outlets 832*a* and the main gas valve port 845*a*. In addition, when the sensing valve component 8*a* moves away from the shooting hole 14*a*, the second stopping gas ring 842*a* can move away from the shooting hole 14*a* with the movement of the sensing valve component 8*a* so as to leave the main gas valve port 845*a* (as shown in FIG. 12). Thus, the sensing valve component 8*a* is opened to make the high-pressure air in the main gas channel 6*a* to enter into the bottom cylinder chamber 24*a* through the gas inlet 831*a*, the guiding hole 83*a*, the gas outlets 832*a* and the main gas valve port 845*a*. Meanwhile, the first stopping gas ring 841*a* is configured for blocking the air in the main gas channel 6 to enter into the shooting hole 14*a*.

Accordingly, when the high-pressure air in the main gas channel 6*a* drives the sensing valve component 8*a* to be closed, the sub gas channel 9*a* guides the high-pressure air in the main air chambers 10*a* to gather and surround the section of the sensing valve component 8*a* between the third stopping gas ring 843*a* and the fourth stopping gas ring 844*a*. The main reason is that the area of the pushing portion 81*a* applied the high-pressure air thereto is larger than that of the contacting portion 86*a*. When the trigger valve 3 is used to control the pneumatic nail gun to hit nails, the main channel 6*a* stops supplying high-pressure air for driving the sensing valve component 8*a* (as shown in FIG. 12). The gathered high-pressure air surrounded the sensing valve component 8*a* can be introduced by the sub gas channel 9*a* to apply a push force to the contacting portion 86*a*, thereby driving the sensing valve component 8*a* to be opened. The other components of the pneumatic nail gun in the third embodiment are identical to these of the pneumatic nail gun in second embodiment and are not described here.

Figure 13:
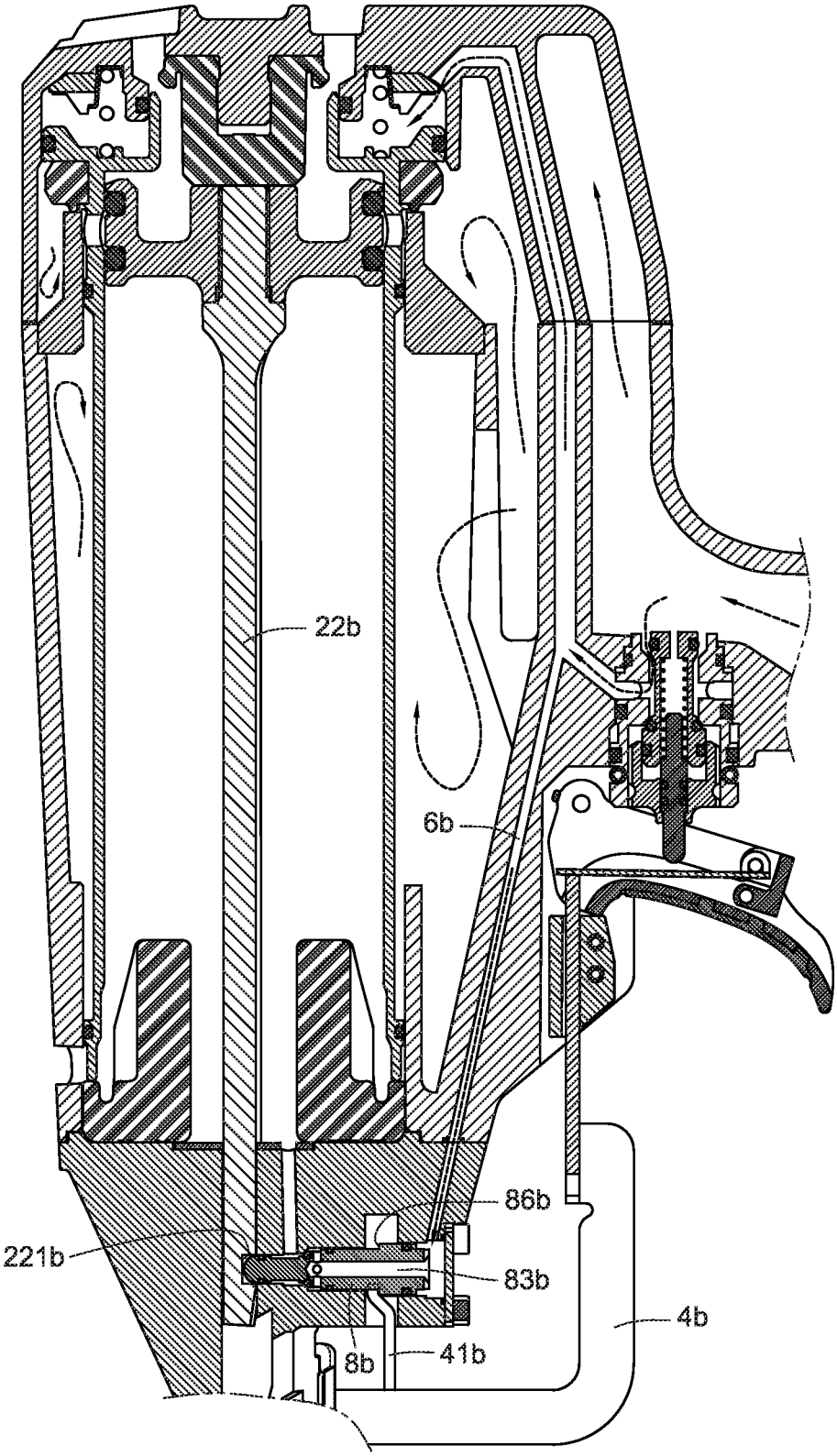
FIG. 13 is a schematic view of a pneumatic nail gun in accordance with a fourth embodiment of the present invention.
Figure 14:
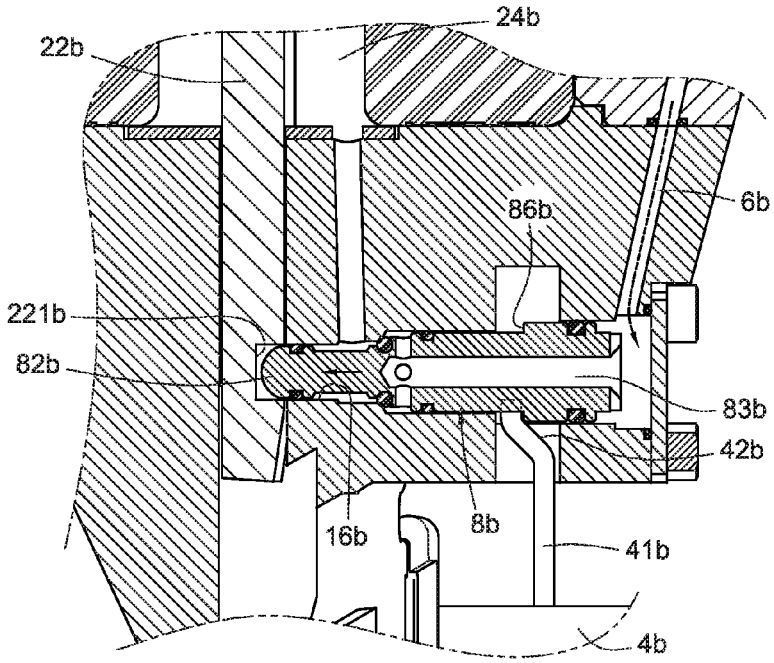
FIG. 14 is a partial exploded view of the pneumatic nail gun shown in FIG. 13.
Figure 15:
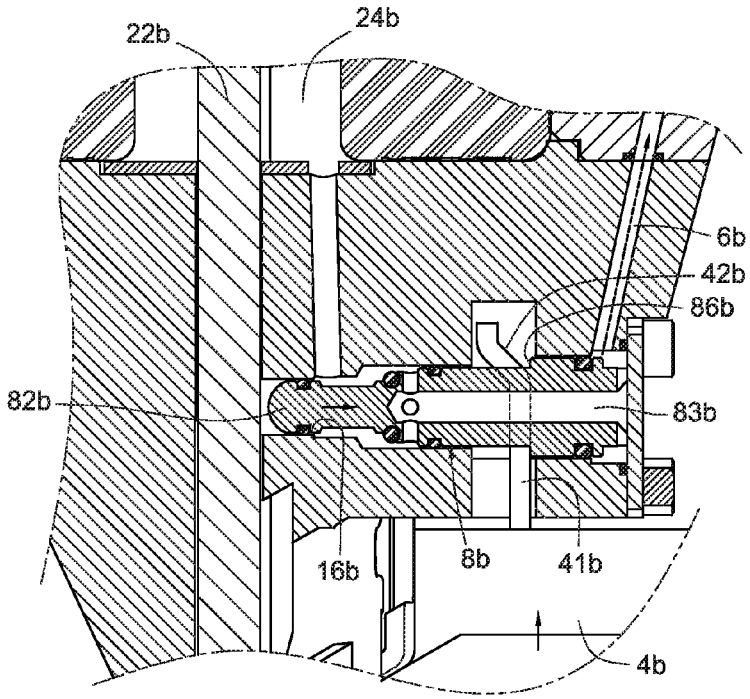
FIG. 15 is a schematic view of the pneumatic nail gun shown in FIG. 14, which is in a using state.

Referring to FIG. 13, a pneumatic nail gun in accordance with the fourth embodiment of the present invention is provided. Referring to FIG. 13 and FIG. 14, a sensing valve component 8*b* also includes an annular contacting portion 86*b* formed on the outside surface of the sensing valve component 8*b*. An end of a work contact element 4*b* is extended to form a push pawl 41*b*. The push pawl 41*b* has a slanted surface 42*b* so that the push pawl 41*b* is capable of pushing and contacting the contacting portion 86*b* within a relative distance. When the work contact element 4*b* moves upwardly to push the contacting portion 86*b* (as shown in FIG. 15), the sensing valve component 8*b* is driven to be opened. When the work contact element 4*b* moves downwardly to release the contacting portion 86*b* (as shown in FIG. 14), the sensing valve component 8*b* is driven to be closed. A guiding hole 83*b* communicated with a main gas channel 6*b* is also formed in the sensing valve component 8*b*. When the sensing valve component 8*b* is opened, the high-pressure air in the main gas channel 6*b* enters into a bottom cylinder chamber 24*b* through the guiding hole 83*b*. When the sensing valve component 8*b* is closed, the high-pressure air in the guiding hole 83*b* is blocked and can not enter into the bottom cylinder chamber

24*b*. The other components of the pneumatic nail gun in the fourth embodiment are identical to these of the pneumatic nail gun in third embodiment and are not described here.

It is noted that the guiding hole 83*a* and 83*b*, the gas inlet 831*a* and the gas outlets 832*a* can be omitted in other embodiments. That is, any design using the main gas valve 84 to control the sensing valve component 8*a* and 8*b* to be opened or to be closed is within the scope and spirit of the invention disclosed herein.

Additionally, a groove 221*b* can be defined on a hitting nail bar 22*b* (as shown in FIG. 13 and FIG. 14). The groove 221*b* is near to the bottom end of the hitting nail bar 22*b*. With the upward movement of the hitting nail bar 22*b*, the groove 221*b* can move upwardly to face to a guiding and supporting opening 16*b*, thereby serving as the extending position of a blocking portion 82*b*.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A driving device for resetting a hitting nail bar of a pneumatic nail gun, which is mounted in a gun body comprising a main air chamber for high-pressure air, a trigger valve, and a cylinder disposed therein, wherein a piston is mounted in the cylinder to divide the cylinder into a top cylinder chamber and a bottom cylinder chamber, and wherein the trigger valve is configured for controlling the high-pressure air in the main air chamber to drive the hitting nail bar connected to the piston to hit nails, the driving device comprising:

a main gas channel communicating with the main air chamber and the bottom cylinder chamber via the trigger valve, the main gas channel being in the gun body for guiding the hitting nail bar; and a sensing valve component slidably disposed in the main gas channel, the sensing valve component being controlled by the position of the hitting nail bar to be either opened or closed, wherein the sensing valve component is opened after the hitting nail bar is driven to move downwardly to hit nails but has not been moved upwardly to reset completely, the high-pressure air is introduced from the main air chamber into the bottom cylinder chamber so as to drive the hitting nail bar to move upwardly to reset, and then the sensing valve component is closed to protrude out of the main gas channel to block in a nail shooting hole and the high-pressure is prevented from entering into the bottom cylinder chamber.

2. The driving device as claimed in claim 1, wherein when the trigger valve is used to control the pneumatic nail gun to hit nails, the high-pressure air is blocked into the main gas channel, and when the trigger valve is not used to control the pneumatic nail gun to hit nails, the high-pressure air is introduce from the main air chamber into the main gas channel.

3. The driving device as claimed in claim 2, wherein when the trigger valve is used to control the pneumatic nail gun to hit nails, the high-pressure air gathered in the main gas channel is introduce to an air outlet, thereby reducing the pressure in the main gas channel.

4. The driving device as claimed in claim 1, wherein the sensing valve component further comprises a blocking portion for sensing a position of the hitting nail bar, the end of the blocking portion has either an arc-shape surface or slanted surface for being attached to the hitting nail bar to force the sensing valve component to be opened.

5. The driving device as claimed in claim 1, further comprising a spring disposed between the sensing valve component and an inside wall of the main gas channel, and the spring being compressed to drive the sensing valve component to be opened on the condition that the sensing valve component is closed.

6. The driving device as claimed in claim 1, further comprising a sub gas channel formed in the gun body for communicating the main air chambers with the sensing valve component, wherein when the sensing valve component is closed, the sub gas channel guides the high-pressure air to gather and surround the sensing valve component so as to drive the sensing valve component to be opened.

7. The driving device as claimed in claim 6, wherein the sensing valve component has a guiding hole communicated with the main gas channel, when the sensing valve component is opened, the high-pressure air in the main gas channel enters into the bottom cylinder chamber through the guiding hole, and when the sensing valve component is closed, the high-pressure air in the guiding hole is blocked into the bottom cylinder chamber.

8. The driving device as claimed in claim 1, wherein the sensing valve component has a contacting portion and an end of a work contact element is extended to form a push pawl, the push pawl has a slanted surface so that the push pawl is capable of pushing and contacting the contacting portion within a relative distance, when the work contact element moves upwardly to push the contacting portion, the sensing valve component is driven to be opened and when the work contact element moves downwardly, the contacting portion is released.

9. The driving device as claimed in claim 8, wherein the sensing valve component has a guiding hole communicating with the main gas channel, when the sensing valve component is opened, the high-pressure air in the main gas channel enters into the bottom cylinder chamber through the guiding hole, and when the sensing valve component is closed, the high-pressure air in the guiding hole is blocked into the bottom cylinder chamber.

10. The driving device as claimed in claim 4, wherein an extending position of the blocking portion is located at the bottom of the hitting nail bar and blocked in the nail shooting hole for guiding the hitting nail bar.

11. The driving device as claimed in claim 10, wherein the hitting nail bar defines a groove thereon, the groove is near to the bottom end of the hitting nail bar and is configured for limiting the extending position of the blocking portion.

12. A driving device for resetting a hitting nail bar of a pneumatic nail gun, which is mounted in a gun body comprising a main air chamber for high-pressure air, a trigger valve, and a cylinder disposed therein, wherein a piston is mounted in the cylinder to divide the cylinder into a top cylinder chamber and a bottom cylinder chamber, and wherein the trigger valve is configured for controlling the high-pressure air in the main air chamber to drive the hitting nail bar connected to the piston to hit nails, the driving device comprising:

a main gas channel communicating with the main air chamber and the bottom cylinder chamber via the trigger valve; and a sensing valve component slidably disposed in the main gas channel, the sensing valve component comprising a pushing portion and a blocking portion, the pushing portion being configured for receiving a drive of the high-pressure air in the main channel, the blocking portion being configured for sensing a position of the hitting nail bar, wherein after the hitting nail bar is driven to move downwardly to hit nails but has not been moved upwardly to reset completely, the blocking portion is blocked by the hitting nail bar to limit the sensing valve component to be closed so that the sensing valve component is in an open state, the high-pressure air in the main gas channel is introduced into the bottom cylinder chamber so as to drive the hitting nail bar to move upwardly to reset, then the block of the hitting nail bar is eliminated so that the high-pressure air continually drives the sensing valve component to be closed and is prevented from entering into the bottom cylinder chamber, and the blocking portion moves to arrive at an extending position for inspecting the reset state of the hitting nail bar, wherein the extending position of the blocking portion is located at the bottom of the hitting nail bar and blocked in a nail shooting hole for guiding the hitting nail bar, thereby finishing a reset operation of driving the hitting nail bar to move upwardly.

13. The driving device as claimed in claim 12, wherein the main gas channel is disposed in the gun body for guiding the hitting nail bar.

14. The driving device as claimed in claim 12, wherein when the sensing valve component is opened, the blocking portion moves to a reset position for releasing the hitting nail bar.

15. The driving device as claimed in claim 12, wherein when the trigger valve is used to control the pneumatic nail gun to hit nails, the high-pressure air is blocked into the main gas channel, and when the trigger valve is not used to control the pneumatic nail gun to hit nails, the high-pressure air is introduce from the main air chamber into the main gas channel.

16. The driving device as claimed in claim 15, wherein when the trigger valve is used to control the pneumatic nail gun to hit nails, the high-pressure air gathered in the main gas channel is introduce to an air outlet, thereby reducing the pressure in the main gas channel.

17. The driving device as claimed in claim 12, wherein the end of the blocking portion has either an arc-shape surface or slanted surface for being attached to the hitting nail bar to force the sensing valve component to be opened.

18. The driving device as claimed in claim 12, further comprising a spring disposed between the sensing valve component and an inside wall of the main gas channel, and the spring being compressed to drive the sensing valve component to be opened on the condition that the sensing valve component is closed.

19. The driving device as claimed in claim 12, further comprising a sub gas channel formed in the gun body for communicating the main air chambers with the sensing valve component, wherein when the sensing valve component is closed, the sub gas channel guides the high-pressure air to gather and surround the sensing valve component so as to drive the sensing valve component to be opened.

20. The driving device as claimed in claim 19, wherein the sensing valve component has a guiding hole communicated with the main gas channel, when the sensing valve component is opened, the high-pressure air in the main gas channel enters into the bottom cylinder chamber through the guiding hole, and when the sensing valve component is closed, the high-pressure air in the guiding hole is blocked into the bottom cylinder chamber.

21. The driving device as claimed in claim 12, wherein the sensing valve component has a contacting portion and an end of a work contact element is extended to form a push pawl, the push pawl has a slanted surface so that the push pawl is capable of pushing and contacting the contacting portion within a relative distance, when the work contact element moves upwardly to push the contacting portion, the sensing valve component is driven to be opened and when the work contact element moves downwardly, the contacting portion is released.

22. The driving device as claimed in claim 21, wherein the sensing valve component has a guiding hole communicating with the main gas channel, when the sensing valve component is opened, the high-pressure air in the main gas channel enters into the bottom cylinder chamber through the guiding hole, and when the sensing valve component is closed, the high-pressure air in the guiding hole is blocked into the bottom cylinder chamber.

23. The driving device as claimed in claim 12, wherein the hitting nail bar defines a groove thereon, the groove is near to the bottom end of the hitting nail bar and is configured for limiting the extending position of the blocking portion.

* * * * *